US011162655B2

(12) United States Patent
Medendorp, Jr. et al.

(10) Patent No.: US 11,162,655 B2
(45) Date of Patent: Nov. 2, 2021

(54) MODULAR LED LIGHTING SYSTEM

(71) Applicant: IDEAL INDUSTRIES LIGHTING LLC, Durham, NC (US)

(72) Inventors: Nicholas William Medendorp, Jr., Raleigh, NC (US); James Michael Lay, Apex, NC (US); Randall Levy Bernard, Cary, NC (US)

(73) Assignee: Ideal Industries Lighting LLC, Racine, WI (US)

( * ) Notice: Subject to any disclaimer, the term of this patent is extended or adjusted under 35 U.S.C. 154(b) by 0 days.

(21) Appl. No.: 17/003,240

(22) Filed: Aug. 26, 2020

(65) Prior Publication Data

US 2020/0393100 A1 Dec. 17, 2020

Related U.S. Application Data

(63) Continuation of application No. 13/910,486, filed on Jun. 5, 2013, now Pat. No. 10,788,176, which is a
(Continued)

(51) Int. Cl.
*F21S 8/04* (2006.01)
*F21V 21/02* (2006.01)
(Continued)

(52) U.S. Cl.
CPC ..... *F21S 8/043* (2013.01); *F21S 2/005* (2013.01); *F21V 15/013* (2013.01);
(Continued)

(58) Field of Classification Search
CPC .... F21S 8/026; F21S 8/043; F21S 8/06; F21S 8/063; F21S 2/005; F21V 15/013;
(Continued)

(56) References Cited

U.S. PATENT DOCUMENTS 3,589,660 A 6/1971 Dunckel
4,073,108 A 2/1978 Williams
(Continued)

FOREIGN PATENT DOCUMENTS

CN 1710323 12/2005
CN 2872082 2/2007
(Continued)

OTHER PUBLICATIONS

Lord Corporation, "Circalok™ conductive adhesive" 6972 and 6968, 2 pages (2013).
(Continued)

*Primary Examiner* — Zheng Song
(74) *Attorney, Agent, or Firm* — Withrow & Terranova, PLLC

(57) ABSTRACT

This disclosure relates to LED based lighting systems, such as surface mounted lighting systems and lighting systems that can connected to an existing grid structure. These lighting systems can be utilized in many settings, for example, as primary lighting systems for a commercial building and for retrofit lighting improvement purposes. Devices according to the present disclosure provide lighting systems capable of mounting to an existing surface, such as a T-bar ceiling structure. These devices can further comprise modular elements which facilitate connections of multiple lighting body components, allowing for multiple lighting arrangements and providing a cost effective and easily configurable lighting design. In some embodiments, multiple lighting components can be attached together by movable joints, allowing further user control over light distribution from the lighting systems.

18 Claims, 9 Drawing Sheets

Related U.S. Application Data continuation-in-part of application No. 13/782,820, filed on Mar. 1, 2013, now Pat. No. 9,482,396, which is a continuation-in-part of application No. 13/672,592, filed on Nov. 8, 2012, now Pat. No. 9,494,304, application No. 17/003,240, which is a continuation-in-part of application No. 13/763,270, filed on Feb. 8, 2013, now Pat. No. 10,309,627, which is a continuation-in-part of application No. 13/672,592, filed on Nov. 8, 2012, now Pat. No. 9,494,304.

(51) Int. Cl.

| | |
|---|---|
| ***F21V 21/15*** | (2006.01) |
| ***F21V 15/01*** | (2006.01) |
| ***F21S 2/00*** | (2016.01) |
| ***F21V 21/005*** | (2006.01) |
| *E04B 9/00* | (2006.01) |
| *F21K 9/20* | (2016.01) |
| *F21Y 115/10* | (2016.01) |

(52) U.S. Cl.
CPC ..... *F21V 21/005* (2013.01); *F21V 21/02* (2013.01); *F21V 21/15* (2013.01); *E04B 9/006* (2013.01); *F21K 9/20* (2016.08); *F21Y 2115/10* (2016.08)

(58) Field of Classification Search
CPC ..... F21V 21/005; F21V 21/02; F21V 21/15; F21K 9/20; F21Y 2115/10; E04B 9/006
See application file for complete search history.

(56) References Cited

U.S. PATENT DOCUMENTS

| | | | |
|---|---|---|---|
| 4,118,763 | A | 10/1978 | Osteen |
| 4,300,185 | A | 11/1981 | Wakamatsu |
| 4,464,707 | A | 8/1984 | Forrest |
| 4,472,767 | A | 9/1984 | Wenman |
| 4,946,547 | A | 8/1990 | Palmour et al. |
| 5,200,022 | A | 4/1993 | Kong et al. |
| 5,335,890 | A | 8/1994 | Pryor et al. |
| RE34,861 | E | 2/1995 | Davis et al. |
| 5,530,628 | A | 6/1996 | Ngai |
| 5,653,412 | A | 6/1997 | Martorano et al. |
| 5,687,527 | A | 11/1997 | Bikard et al. |
| 5,690,415 | A | 11/1997 | Krehl |
| 5,823,663 | A | 10/1998 | Bell et al. |
| 5,907,218 | A | 5/1999 | Altman et al. |
| 5,951,150 | A | 9/1999 | Helstern |
| 6,190,198 | B1 | 2/2001 | Ray |
| 6,210,025 | B1 | 4/2001 | Schmidt et al. |
| 6,435,697 | B1 | 8/2002 | Simmons et al. |
| 6,536,924 | B2 | 3/2003 | Segretto |
| 6,667,451 | B1 | 12/2003 | Hart |
| 6,739,734 | B1 | 5/2004 | Hulgan |
| 6,914,194 | B2 | 7/2005 | Fan |
| 7,131,747 | B1 | 11/2006 | Yates |
| 7,161,554 | B2 | 1/2007 | Nugnes et al. |
| 7,213,940 | B1 | 5/2007 | Van De Ven et al. |
| 7,217,023 | B2 | 5/2007 | Iwasa et al. |
| 7,228,253 | B2 | 6/2007 | Chen et al. |
| 7,267,461 | B2 | 9/2007 | Kan et al. |
| 7,303,310 | B2 | 12/2007 | You et al. |
| 7,387,410 | B2 | 6/2008 | Sibout |
| 7,520,636 | B2 | 4/2009 | Van Der Poel |
| 7,540,627 | B2 | 6/2009 | Handsaker |
| 7,591,578 | B2 | 9/2009 | Chang |
| 7,628,506 | B2 | 12/2009 | Verfuerth et al. |
| 7,654,703 | B2 | 2/2010 | Kan et al. |
| 7,674,005 | B2 | 3/2010 | Chung et al. |
| 7,722,220 | B2 | 5/2010 | Van De Ven |
| 7,758,207 | B1 | 7/2010 | Zhou et al. |
| 7,791,061 | B2 | 9/2010 | Edmond et al. |
| 8,058,088 | B2 | 11/2011 | Cannon et al. |
| 8,206,004 | B2 | 6/2012 | Serak et al. |
| 8,220,953 | B1 | 7/2012 | Moore |
| 8,313,212 | B1 | 11/2012 | Mayer et al. |
| 8,317,369 | B2 | 11/2012 | McCanless |
| 8,342,714 | B1 | 1/2013 | Rea et al. |
| 8,360,599 | B2 | 1/2013 | Ivey et al. |
| 8,376,578 | B2 | 2/2013 | Kong et al. |
| 8,459,824 | B1 | 6/2013 | Esmailzadeh et al. |
| 8,523,383 | B1 | 9/2013 | Grigore et al. |
| 8,678,611 | B2 | 3/2014 | Chu et al. |
| 8,714,770 | B2 | 5/2014 | Kato et al. |
| 8,764,220 | B2 | 7/2014 | Chan et al. |
| 8,777,448 | B2 | 7/2014 | Shimizu et al. |
| 8,888,314 | B2 | 11/2014 | Gill |
| 9,057,493 | B2 | 6/2015 | Simon et al. |
| 2001/0048599 | A1 | 12/2001 | Hess |
| 2004/0190330 | A1 | 6/2004 | Pare |
| 2004/0240214 | A1 | 12/2004 | Whitlow et al. |
| 2004/0252521 | A1 | 12/2004 | Clark et al. |
| 2005/0041418 | A1 | 2/2005 | Fan |
| 2005/0146867 | A1 | 7/2005 | Kassay et al. |
| 2006/0050505 | A1 | 3/2006 | McCarthy et al. |
| 2006/0266955 | A1 | 11/2006 | Arvin et al. |
| 2006/0278882 | A1 | 12/2006 | Leung et al. |
| 2007/0109330 | A1 | 5/2007 | Brown Elliott et al. |
| 2007/0158668 | A1 | 7/2007 | Tarsa et al. |
| 2007/0171647 | A1 | 7/2007 | Artwohl et al. |
| 2007/0183148 | A1 | 8/2007 | Mayfield, III et al. |
| 2008/0128723 | A1 | 6/2008 | Pang |
| 2008/0173884 | A1 | 7/2008 | Chitnis et al. |
| 2008/0179611 | A1 | 7/2008 | Chitnis et al. |
| 2008/0258130 | A1 | 10/2008 | Bergmann et al. |
| 2008/0285267 | A1 | 11/2008 | Santoro |
| 2008/0314944 | A1 | 12/2008 | Tsai et al. |
| 2009/0009999 | A1 | 1/2009 | Wang et al. |
| 2009/0040782 | A1 | 2/2009 | Liu et al. |
| 2009/0046457 | A1 | 2/2009 | Everhart |
| 2009/0161356 | A1 | 6/2009 | Negley et al. |
| 2009/0184333 | A1 | 7/2009 | Wang et al. |
| 2009/0185379 | A1 | 7/2009 | Chen |
| 2009/0207602 | A1 | 8/2009 | Reed et al. |
| 2009/0212304 | A1 | 8/2009 | Wang et al. |
| 2009/0296381 | A1 | 8/2009 | Dubord |
| 2009/0224265 | A1 | 9/2009 | Wang et al. |
| 2009/0283787 | A1 | 11/2009 | Donofrio et al. |
| 2009/0290345 | A1 | 11/2009 | Shaner |
| 2009/0290348 | A1 | 11/2009 | Van Laanen et al. |
| 2010/0002426 | A1 | 1/2010 | Wu et al. |
| 2010/0014289 | A1 | 1/2010 | Thomas et al. |
| 2010/0110701 | A1 | 5/2010 | Liu et al. |
| 2010/0128485 | A1 | 5/2010 | Teng et al. |
| 2010/0142205 | A1 | 6/2010 | Bishop |
| 2010/0155763 | A1 | 6/2010 | Donofrio et al. |
| 2010/0171404 | A1 | 7/2010 | Liu et al. |
| 2010/0214770 | A1 | 8/2010 | Anderson |
| 2010/0214785 | A1 | 8/2010 | Chen |
| 2010/0220469 | A1 | 9/2010 | Ivey et al. |
| 2010/0259927 | A1 | 10/2010 | Chien |
| 2010/0271804 | A1 | 10/2010 | Levine |
| 2010/0271825 | A1 | 10/2010 | Black et al. |
| 2010/0328945 | A1 | 12/2010 | Song et al. |
| 2011/0006688 | A1 | 1/2011 | Shim |
| 2011/0007514 | A1 | 1/2011 | Sloan et al. |
| 2011/0013400 | A1 | 1/2011 | Kanno et al. |
| 2011/0028006 | A1 | 2/2011 | Shah et al. |
| 2011/0090682 | A1 | 4/2011 | Zheng et al. |
| 2011/0103043 | A1 | 5/2011 | Ago et al. |
| 2011/0163683 | A1 | 7/2011 | Steele et al. |
| 2011/0211330 | A1 | 9/2011 | Wang |
| 2011/0222270 | A1 | 9/2011 | Porciatti |
| 2011/0285314 | A1 | 11/2011 | Carney et al. |
| 2011/0286207 | A1 | 11/2011 | Chan et al. |
| 2011/0286208 | A1 | 11/2011 | Chen |
| 2011/0310604 | A1 | 12/2011 | Shimizu et al. |
| 2011/0310614 | A1 | 12/2011 | Budike, Jr. |
| 2012/0002408 | A1 | 1/2012 | Lichten et al. |
| 2012/0020109 | A1 | 1/2012 | Kim et al. |
| 2012/0051041 | A1 | 3/2012 | Edmond et al. |

(56) References Cited

U.S. PATENT DOCUMENTS

| | | | | |
|---|---|---|---|---|
| 2012/0075857 | A1 | 3/2012 | Verbrugh | |
| 2012/0081883 | A1 | 4/2012 | Wang | |
| 2012/0092876 | A1 | 4/2012 | Chang et al. | |
| 2012/0098424 | A1 | 4/2012 | Arik et al. | |
| 2012/0120666 | A1 | 5/2012 | Moeller | |
| 2012/0169234 | A1 | 7/2012 | Shew | |
| 2012/0182755 | A1 | 7/2012 | Wildner | |
| 2012/0201023 | A1 | 8/2012 | Yoneda | |
| 2012/0218757 | A1 | 8/2012 | Gill | |
| 2012/0235199 | A1 | 9/2012 | Andrews et al. | |
| 2012/0250302 | A1 | 10/2012 | Edwards et al. | |
| 2013/0021803 | A1 | 1/2013 | Pickard | |
| 2013/0039090 | A1 | 2/2013 | Dau et al. | |
| 2013/0050998 | A1 | 2/2013 | Chu et al. | |
| 2013/0063948 | A1* | 3/2013 | Ishii | F21S 8/04 362/294 |
| 2013/0083514 | A1 | 4/2013 | Wong et al. | |
| 2013/0093359 | A1 | 4/2013 | Hsu et al. | |
| 2013/0094224 | A1 | 4/2013 | Miyatake et al. | |
| 2013/0094225 | A1 | 4/2013 | Leichner | |
| 2013/0155670 | A1 | 6/2013 | Handsaker | |
| 2013/0176721 | A1 | 7/2013 | Lu et al. | |
| 2013/0242548 | A1 | 9/2013 | Ter-Hovhannisyan | |
| 2013/0258616 | A1 | 10/2013 | Chao et al. | |
| 2013/0265772 | A1 | 10/2013 | Lu et al. | |
| 2013/0271979 | A1 | 10/2013 | Pearson et al. | |
| 2013/0279156 | A1 | 10/2013 | Kaule et al. | |
| 2013/0279180 | A1 | 10/2013 | Pearson et al. | |
| 2013/0328073 | A1 | 12/2013 | Lowes | |
| 2013/0328074 | A1 | 12/2013 | Lowes et al. | |
| 2013/0329425 | A1 | 12/2013 | Lowes et al. | |
| 2014/0043802 | A1 | 2/2014 | Dings et al. | |
| 2014/0085861 | A1 | 3/2014 | Nicolai et al. | |
| 2014/0104843 | A1 | 4/2014 | McCane et al. | |
| 2014/0126195 | A1 | 5/2014 | Dixon | |
| 2014/0126196 | A1 | 5/2014 | Dixon et al. | |
| 2014/0126199 | A1 | 5/2014 | Heeter et al. | |
| 2014/0265809 | A1 | 9/2014 | Hussell | |
| 2014/0313731 | A1 | 10/2014 | Kwak et al. | |
| 2015/0016100 | A1 | 1/2015 | Ishii | |
| 2015/0022999 | A1 | 1/2015 | Yu et al. | |
| 2015/0155427 | A1 | 6/2015 | Jang et al. | |
| 2016/0025278 | A1 | 1/2016 | Camarota | |

FOREIGN PATENT DOCUMENTS

| | | |
|---|---|---|
| CN | 101984284 | 3/2011 |
| CN | 101994939 | 3/2011 |
| KR | 20100012997 | 12/2010 |
| WO | 2008003289 | 1/2008 |

OTHER PUBLICATIONS

WhiteOptics "WhiteOptics™ White Film" Reflector Film Technical Data Sheet; 1 page (available at least as early as Nov. 14, 2013).
Leviton "Leviton LED Magnetic Tube Retrofit Series" datasheet, 1 page, www.leviton.com (2014).
Non-Final Office Action for U.S. Appl. No. 13/910,486, dated May 7, 2015, 11 pages.
Final Office Action for U.S. Appl. No. 13/910,486, dated Oct. 15, 2015, 11 pages.
Advisory Action for U.S. Appl. No. 13/910,486, dated Dec. 31, 2015, 3 pages.
Non-Final Office Action for U.S. Appl. No. 13/910,486, dated Mar. 1, 2016, 14 pages.
Final Office Action for U.S. Appl. No. 13/910,486, dated Jun. 23, 2016, 12 pages.
Non-Final Office Action for U.S. Appl. No. 13/910,486, dated Dec. 14, 2016, 12 pages.
Final Office Action for U.S. Appl. No. 13/910,486, dated Apr. 20, 2017, 16 pages.
Advisory Action for U.S. Appl. No. 13/910,486, dated Jul. 19, 2017, 4 pages.
Non-Final Office Action for U.S. Appl. No. 13/910,486, dated Aug. 28, 2017, 17 pages.
Final Office Action for U.S. Appl. No. 13/910,486, dated Feb. 5, 2018, 17 pages.
Advisory Action for U.S. Appl. No. 13/910,486, dated Apr. 26, 2018, 3 pages.
Non-Final Office Action for U.S. Appl. No. 13/910,486, dated Jun. 29, 2018, 20 pages.
Final Office Action for U.S. Appl. No. 13/910,486, dated Apr. 22, 2019, 18 pages.
Advisory Action for U.S. Appl. No. 13/910,486, dated Jul. 23, 2019, 3 pages.
Non-Final Office Action for U.S. Appl. No. 13/910,486, dated Nov. 18, 2019, 22 pages.
Final Office Action for U.S. Appl. No. 13/910,486, dated Apr. 2, 2020, 14 pages.
Notice of Allowance for U.S. Appl. No. 13/910,486, dated May 27, 2020, 9 pages.

* cited by examiner

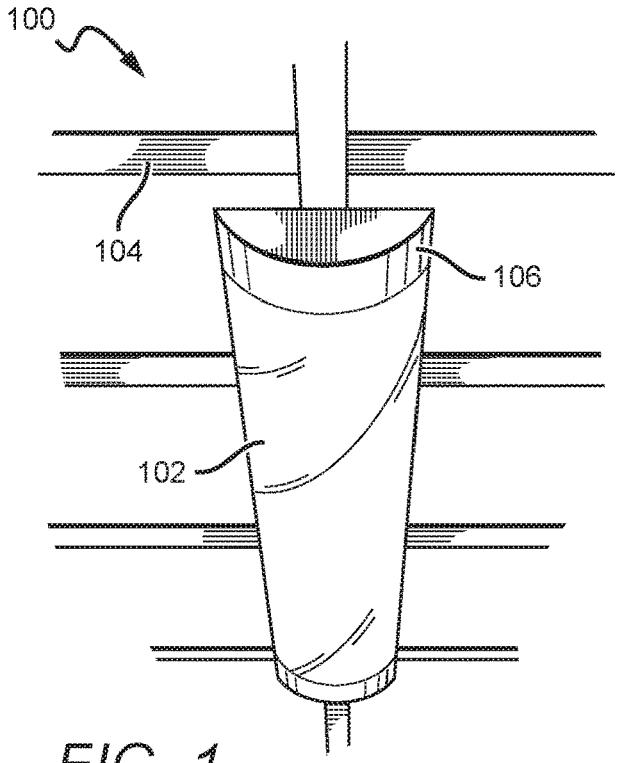
FIG. 1
FIG. 2
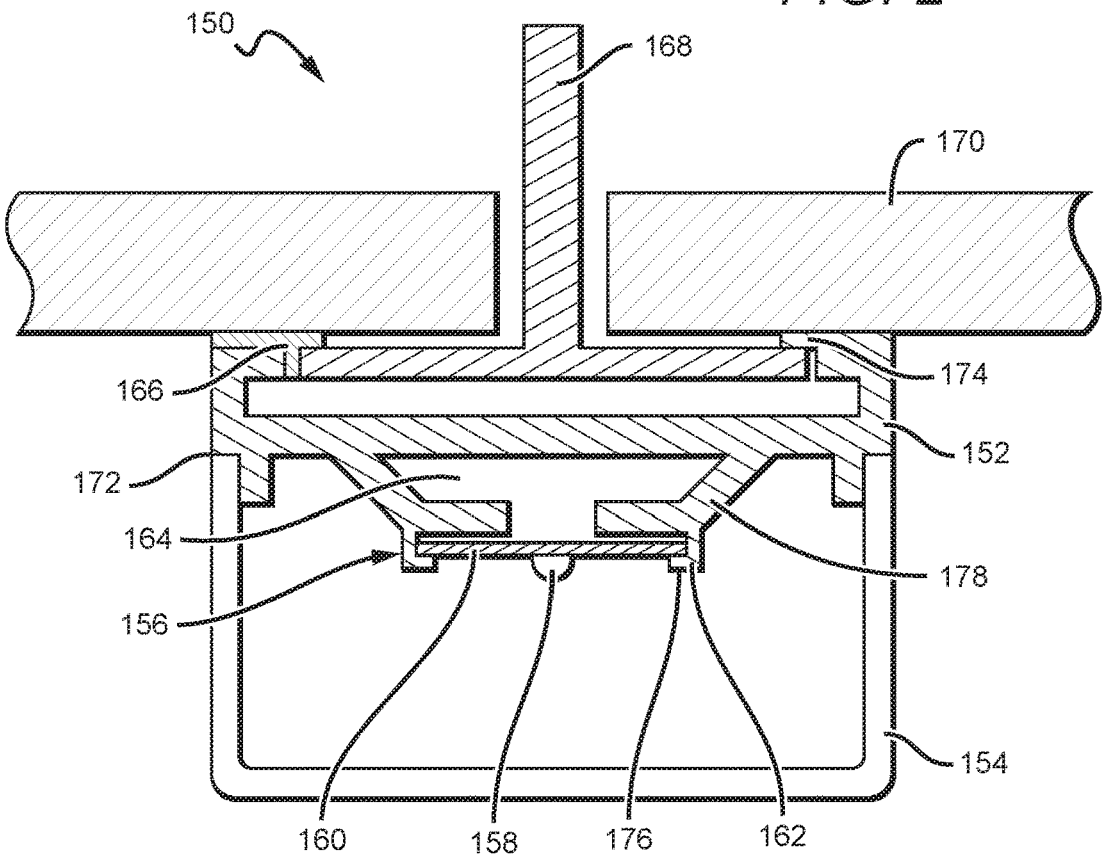

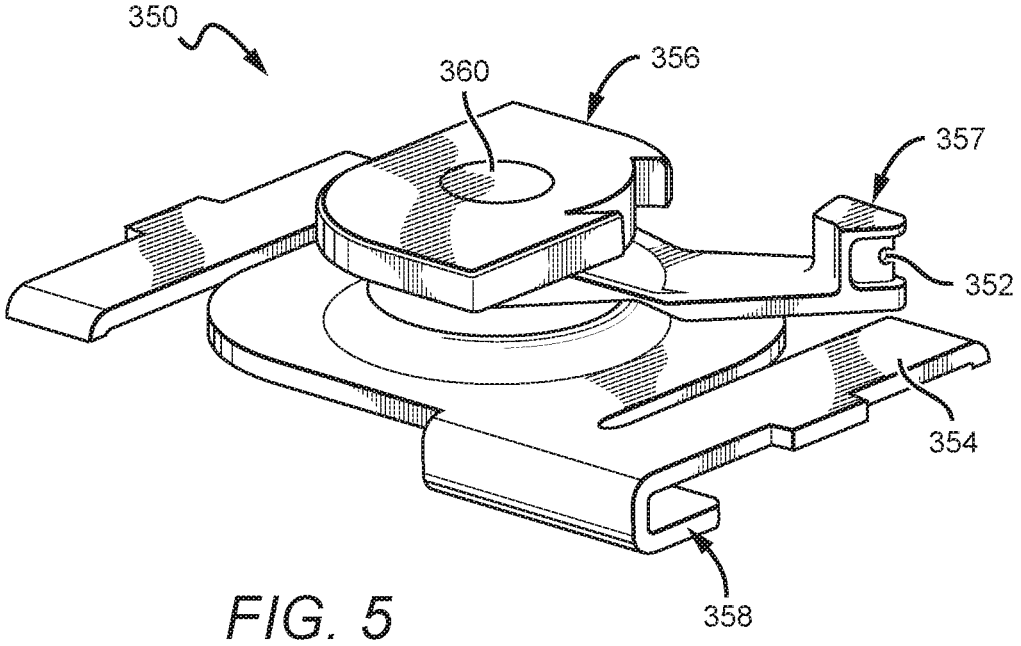
FIG. 5
FIG. 6
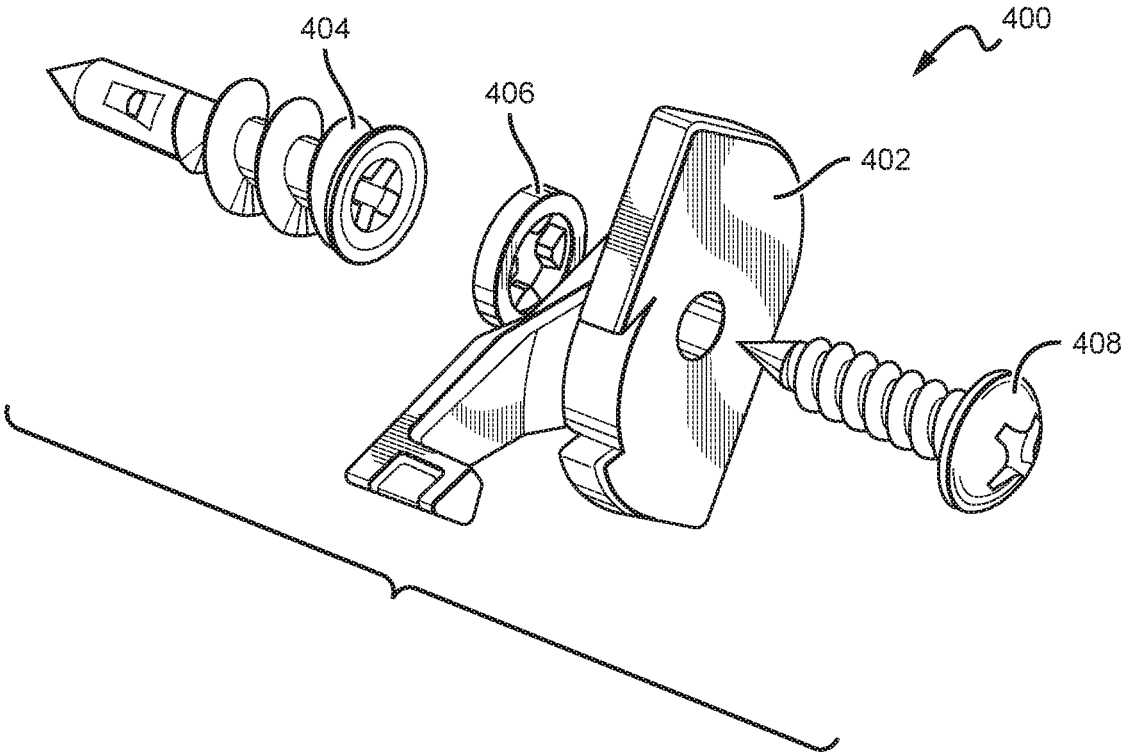

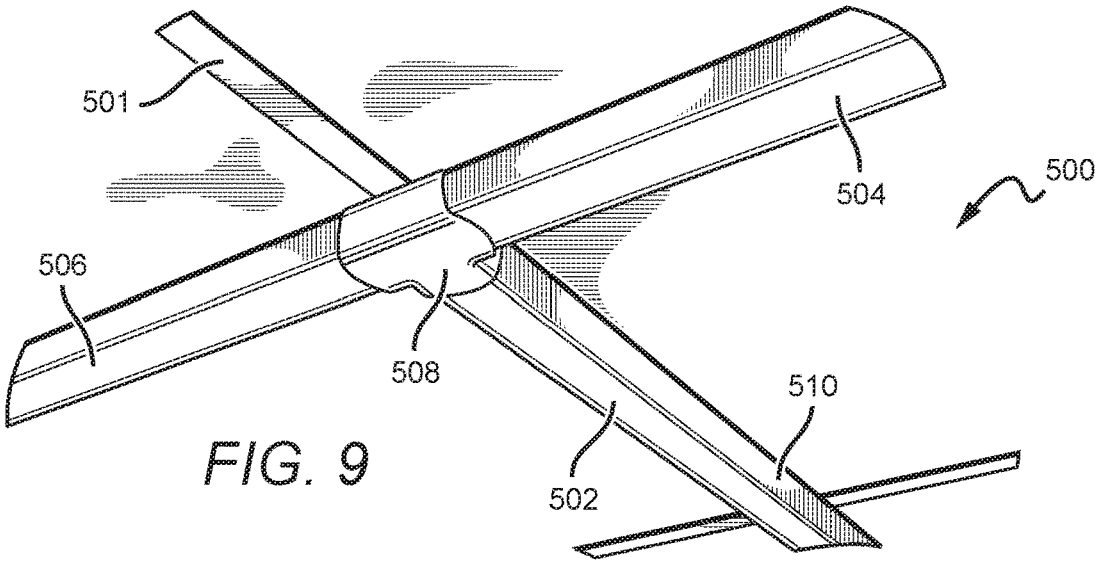
FIG. 9
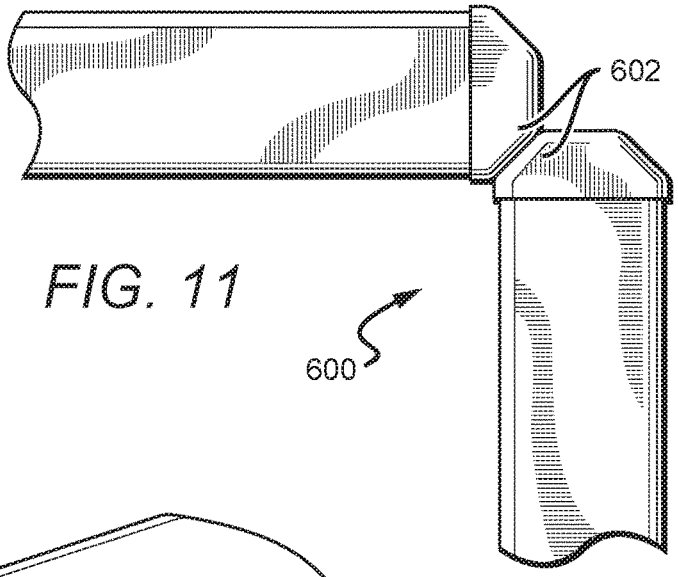
FIG. 11
FIG. 10
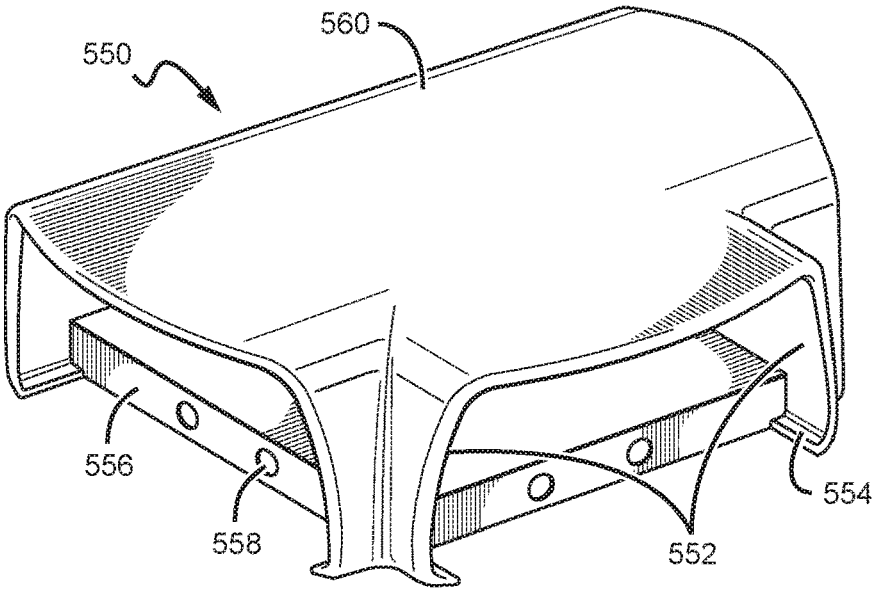

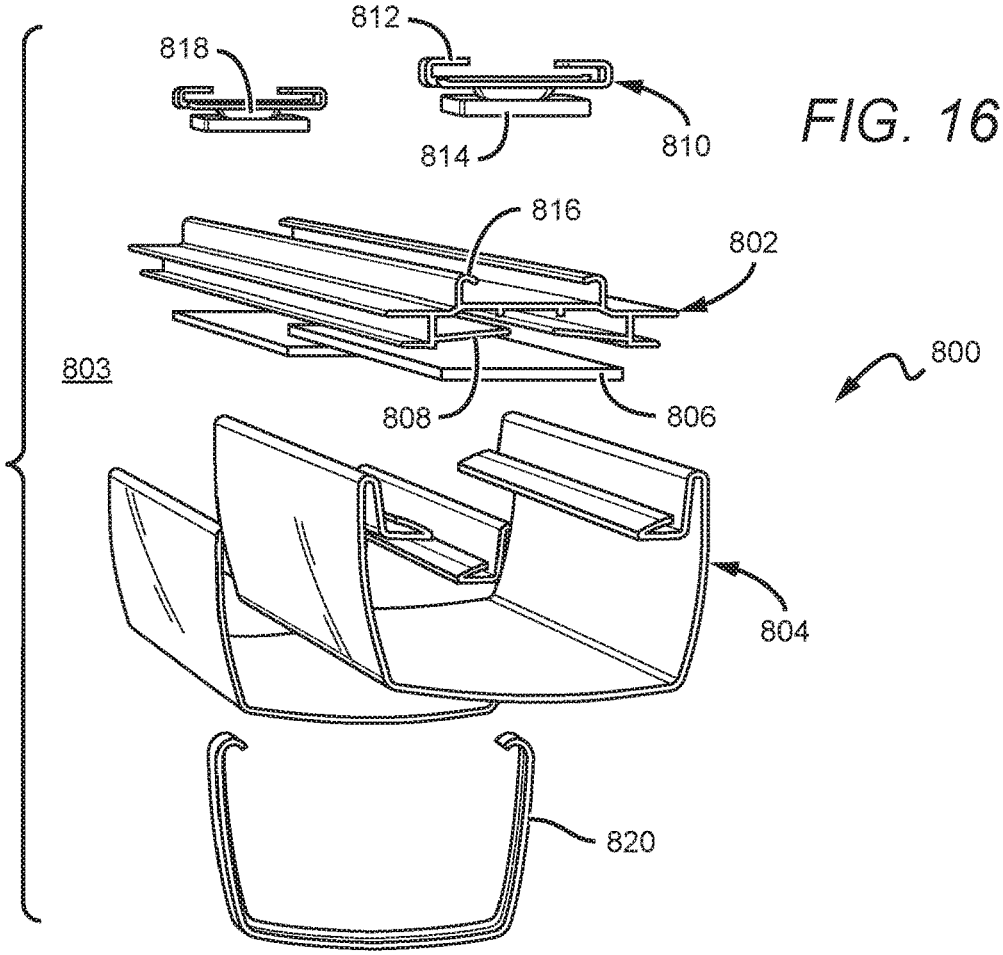
FIG. 16
FIG. 17
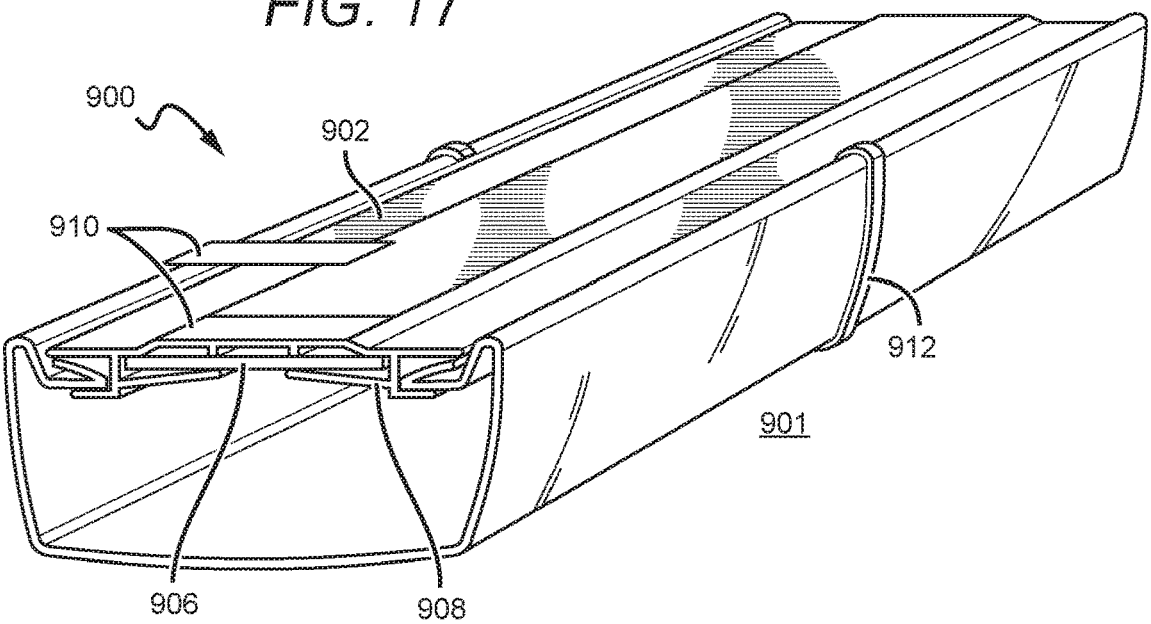

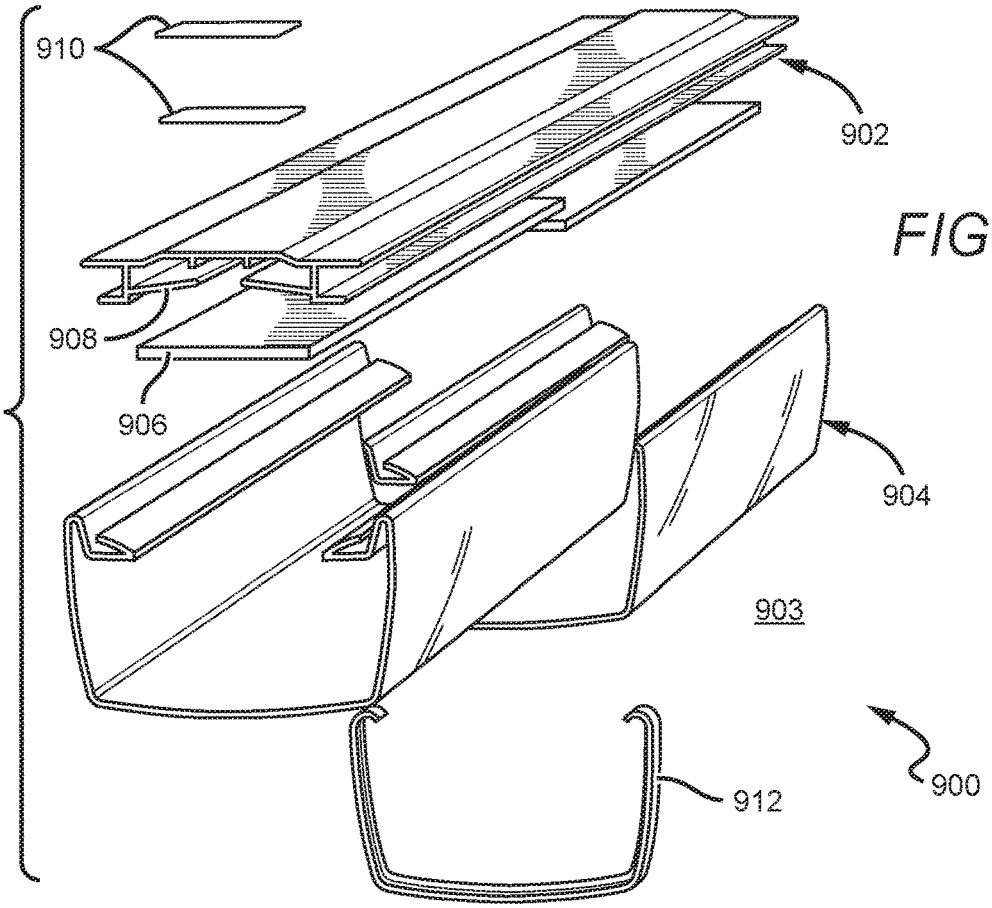
FIG. 18
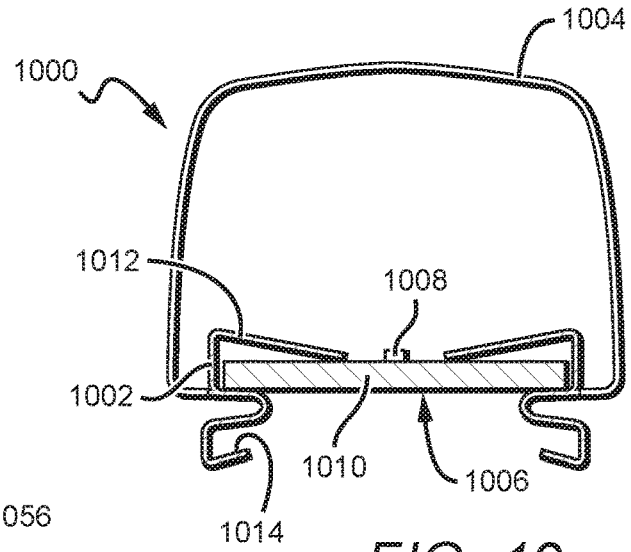
FIG. 19
FIG. 20
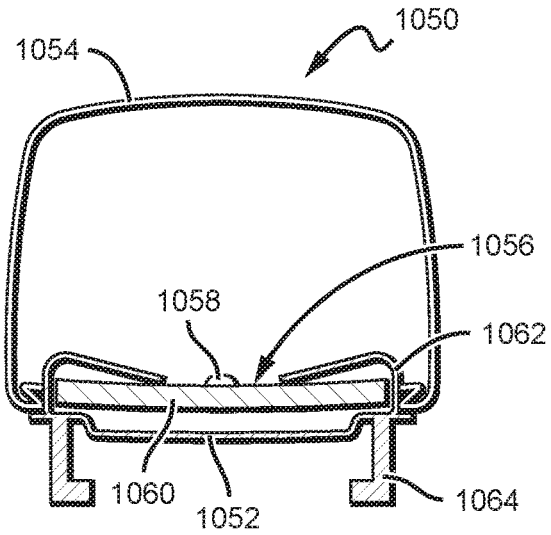

MODULAR LED LIGHTING SYSTEM

CROSS REFERENCE TO RELATED APPLICATIONS

This application is a continuation of U.S. patent application Ser. No. 13/910,486 filed Jun. 5, 2013 and issued as U.S. Pat. No. 10,788,176, which is a continuation in part of, and claims the benefit of, U.S. patent application Ser. No. 13/782,820 filed Mar. 1, 2013 and issued as U.S. Pat. No. 9,482,396, which is a continuation in part of and claims the benefit of U.S. patent application Ser. No. 13/672,592 filed Nov. 8, 2012 and issued as U.S. Pat. No. 9,494,304. This application is also a continuation in part of, and claims the benefit of, U.S. patent application Ser. No. 13/763,270 filed Feb. 8, 2013 and issued as U.S. Pat. No. 10,309,627, which is also a continuation in part of and claims the benefit of U.S. patent application Ser. No. 13/672,592 filed on Nov. 8, 2012 and issued as U.S. Pat. No. 9,494,304. All of these above applications are hereby incorporated herein in their entirety by reference, including the drawings, charts, schematics, diagrams and related written description.

BACKGROUND OF THE INVENTION

Field of the Invention

Described herein are devices relating to lighting systems, such as surface mounted lighting systems, that are well suited for use with solid state lighting sources, such as light emitting diodes (LEDs).

Description of the Related Art

A common ceiling surface arrangement within commercial office and industrial spaces is the "suspended ceiling." A suspended ceiling typically comprises a grid of interconnected metal "T-bars," which is suspended at a height corresponding to the desired height for the ceiling. Ceiling tiles, which have dimensions matching gaps in the surface T-bar grid, are then placed within these gaps to complete the dropped ceiling. These T-bars typically have a shape with a vertically extending spine portion and a horizontally extending rest shelf so that the T-bar typically comprises the shape of the letter "T."

The space immediately above the suspended ceiling typically comprises a plenum area that can house various heating, ventilating and air conditioning (HVAC) components. In portions of the suspended ceiling wherein ceiling tiles are not utilized, Troffer-style lighting fixtures are commonly utilized and are typically at least partially recessed into the ceiling, with the back side of the troffer protruding into the plenum area above the ceiling. U.S. Pat. No. 5,823,663 to Bell, et al. and U.S. Pat. No. 6,210,025 to Schmidt, et al. are examples of typical troffer-style fixtures. Most of these troffer lighting fixtures house fluorescent light bulbs that span the length of the troffer.

More recently, with the advent of the efficient solid state lighting sources, troffers and other commercial lighting fixtures have been developed that utilize LEDs as their light source. LEDs are solid state devices that convert electric energy to light and typically comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications, including commercial lighting fixtures. An increase in the adoption of LEDs in place of incandescent or fluorescent lighting would result in increased lighting efficiency and significant energy saving.

Due to the many advantages LEDs provide over traditional incandescent or fluorescent lighting, some buildings have be "retrofitted" to replace the above-mentioned traditional troffers with LED-based lighting systems. Recently, such retrofits have included modifying and replacing portions of an existing T-bar grid structure so that one or more T-bars are physically replaced by an LED-based lighting fixture. An example of such a retrofit arrangement can be found in United States Pre-Grant Patent Publication US 2011/0222270 A1, to Porciatti. However, these retrofits are incapable of connecting to an existing T-bar grid, as the T-bar grid itself must be dissembled to accommodate these retrofit fixtures. Furthermore, these fixtures substantially extend into the ceiling plenum space which can potentially conflict with HVAC and Fire Safety Regulations depending on the material used, the placement of the fixture and the local laws. Also, these fixtures utilize component pieces that must physically replace portions of the T-grid and are not freely adjustable or modular, thus restricting lighting arrangement design and complicating the retrofit process.

SUMMARY OF THE INVENTION

The present invention is generally directed to lighting systems that can comprise modular components and that can connect to a surface, such as an existing surface grid system (e.g. a T-bar grid), an existing track lighting arrangement, other lighting systems, furniture, appliances, or at least a portion of a unistrut framing structure. These lighting systems can connect to an existing surface grid system without necessitating disassembly or alteration of the underlying surface grid system. Lighting systems incorporating features of the present invention can be utilized to provide light to a given area as well as being part of a lighting improvement retrofit process, replacing traditional troffer-style lighting fixtures. Lighting systems according to the present disclosure can comprise features allowing for modular connection of additional components and/or re-arrangement of connected components. These modular features provide increased customization of light output and increased lighting arrangement design options.

In some embodiments, the lighting systems can comprise one or more lighting body components wherein at least a portion of one or more of the lighting body components can comprise a lens. Multiple lighting body components can be connected together through modular joint connections resulting in a customizable lighting system arrangement. In some embodiments, the lighting systems comprise a mounting mechanism that facilitates connection to an existing surface structure such as a surface grid structure in a ceiling or a wall (e.g. a T-bar grid).

One embodiment of a lighting system according to the present disclosure comprises one or more body components arranged to connect to a surface, wherein at least a portion of each of said one or more body components comprises a lens. In this embodiment, at least one of the body components is arranged to receive at least one LED based lighting element. The lighting system of this embodiment further comprises at least one connection joint arranged such that additional body components can be connected to the present body components.

Another embodiment of a lighting system according to the present disclosure comprises a body component arranged to connect to an existing surface grid structure, wherein at least a portion of the body component can comprise a lens. The body component is arranged to receive at least one LED based lighting element.

Still another embodiment of a lighting fixture according to the present disclosure comprises a first body component arranged to connect to an existing surface grid structure, wherein at least a portion of the first body component comprises a lens. The system further comprises an LED based lighting element housed within the first body component, at least one additional body component and at least one connection joint arranged such that the first body component can connect to additional body component.

These and other further features and advantages of the invention would be apparent to those skilled in the art from the following detailed description, taken together with the accompanying drawings, wherein like numerals designate corresponding parts in the figures, in which:

BRIEF DESCRIPTION OF THE DRAWINGS

FIG. 1 is a bottom perspective view of an embodiment of a lighting system according to the present disclosure;

FIG. 2 is a front sectional view of an embodiment of a lighting system according to the present disclosure;

FIG. 5 is a front-side perspective view of a surface mounting mechanism that can be utilized with lighting systems according to the present disclosure;

FIG. 6 is an exploded view of a surface mounting mechanism that can be utilized with lighting systems according to the present disclosure;

FIG. 9 is a bottom perspective view of an embodiment of a lighting system according to the present disclosure;

FIG. 10 is a front perspective view of a connection joint that can be utilized with lighting systems according to the present disclosure;

FIG. 11 is a partial bottom view of body components that can be utilized with lighting systems according to the present disclosure;

FIG. 16 is an exploded view of the embodiment of a lighting system shown in FIG. 15;

FIG. 17 is a front perspective view of an embodiment of a lighting system according to the present disclosure;

FIG. 18 is an exploded view of the embodiment of a lighting system shown in FIG. 17;

FIG. 19 is a front sectional view of an embodiment of a lighting system according to the present disclosure; and FIG. 20 is a front sectional view of an embodiment of a lighting system according to the present disclosure.

DETAILED DESCRIPTION OF THE INVENTION

Figure 3:
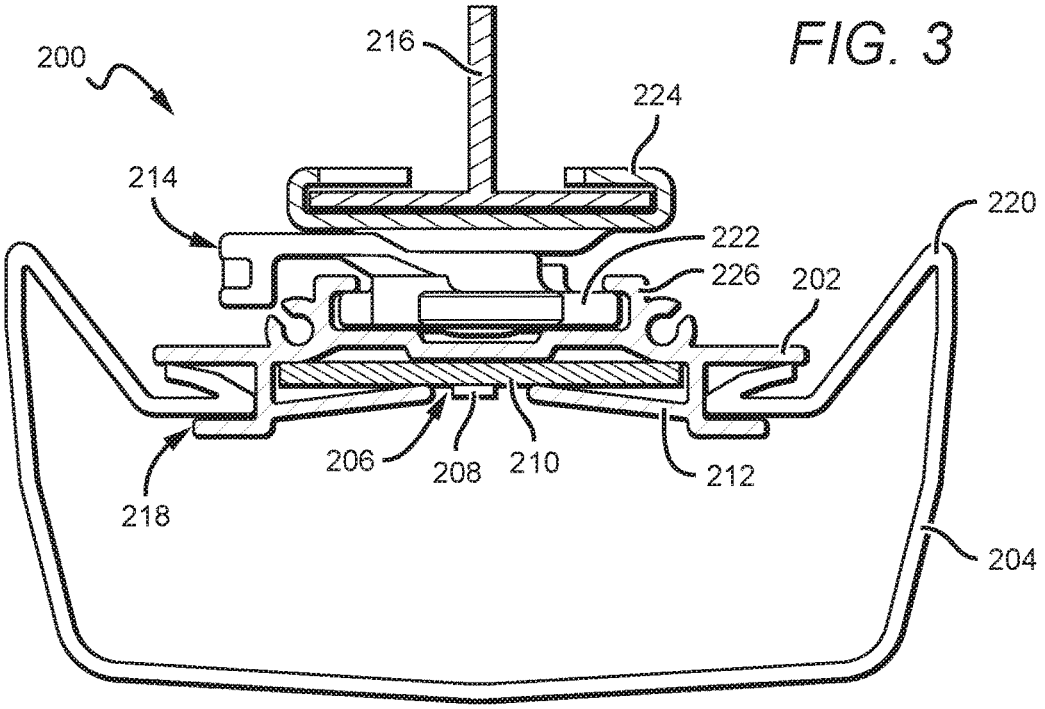
FIG. 3 is a front sectional view of an embodiment of a lighting system according to the present disclosure.

The present disclosure is directed to different embodiments of lighting systems comprising one or more body components that can connect to a surface and be modularly arranged into desired lighting arrangement patterns. In some embodiments, these lighting systems can connect to existing surface grid systems, such as a ceiling T-bar grid and can comprise or not comprise modular components. In some embodiments, devices according to the present disclosure comprise at least one body component and at least one lighting element. The body component can be made of various materials including but not limited to: metals, plastics, acrylics, resins, Poly(methyl methacrylate) (PMMA), polycarbonate (PC), and materials known in the art to provide a desirable effect on emitted light; the body component can also comprises an alloy of or combination of one or more of these materials. The body component can be formed in a number of different ways including but not limited to machining, molding (such as injection molding), extrusion and co-extrusion.

At least a portion of the body component can comprise a lens which can comprise transparent, translucent, diffusive and/or opaque portions. The lens can be arranged to diffuse, magnify, or otherwise alter light output. The lens can be made of the same material as the body component or can be made from a different material and integrated into the body component, for example via a co-extrusion process. The lens can also be a separate physical component connected to the body. The lens can comprise additional structures and materials or can be treated with various processes to allow the lens to alter the color of emitted light, with some embodiments comprising wavelength-altering materials such as phosphors. In other embodiments, the lens can comprise light scattering particles and can be structured or patterned to increase light extraction. Light altering properties, such as diffusive properties, can also be imparted to the lens by physically roughening the surface of the lens, for example, via a machining process.

Many different lighting elements can be utilized with lighting systems incorporating features of the present invention. The lighting elements can comprise, for example, one or more LEDs, one or more LED packages, LED arrays, and LED-based light engines. Many different LEDs can be utilized with lighting elements according to the present disclosure. For example, the LEDs can comprise highly efficient LED packages that are capable of operating at lower drive signals than many conventionally used LEDs. Since the current needed to drive such highly efficient LEDs can be lower, the power in each LED can also be lower. Multiple LEDs can be used to achieve the same output as fewer LEDs with a higher current. Examples of such highly efficient LEDs are described in detail in U.S. patent application Ser. Nos. 13/649,052, (issued as U.S. Pat. No. 9,048,396), 13/649,067 (issued as U.S. Pat. No. 9,818,919), and 13/770,389 (published as U.S. Patent Application Publication No. 2013/0328074), all of which are assigned to Cree, Inc., which are hereby incorporated herein in their entirety by reference, including the drawings, charts, schematics, diagrams and related written description.

One way in which such highly efficient LEDs can operate at lower drive signals than convention LEDs is that the highly efficient LED packages have a greater LED area per package footprint, which can allow for higher packing density. In many applications, this allows for driving the same area of LED packages with a lower drive signal to achieve the same emission intensity. This can result in greater emission efficiency. In other embodiments, the same drive current can be used, and the LED packages that can be utilized with the present invention can be used to generate higher emission intensity. These embodiments provide the flexibility of providing LED package emission with high luminous flux, or with lower luminous flux at greater efficiency.

Lighting elements utilized in embodiments according to the present disclosure can be connected to a printed circuit board ("PCB"). The PCB can be connected to the body component in various ways, including but not limited to using adhesives and using securing mechanisms integrated with the body component. An alternative to utilizing a printed circuit board is to utilize a conductive element arrangement. Such a conductive element arrangement can include, for example, copper wire, conductive rails, magnet wire, non-conductive materials selectively coated with conductive materials, flattened braided wire and flex circuits on polyamide film. These and other substitutes for a traditional PCB are discussed in detail in U.S. patent application Ser. No. 13/782,820 (issued as U.S. Pat. No. 9,482,396) to Mark Dixon, et al., entitled Integrated Linear Light Engine, which is hereby incorporated in its entirety by reference into the present application, including the drawings, charts, schematics, diagrams and related written description.

Lighting systems according to the present disclosure can further comprise connection joints which allow for multiple body components to connect to one another. These connection joints enable the lighting systems to be modular and able to be configured with multiple body components in various arrangements depending on the desired lighting profile in a given space. In some embodiments, these connection joints are flexible and/or comprise moving components, such as a ball and socket, hinge or rotational joint portion. These connection joints will be discussed in further detail below.

The body component can further comprise a mounting mechanism. This mounting mechanism can connect the body component to a surface such as a ceiling or a wall, for example by connecting to an existing surface grid, such as a ceiling T-bar grid. The mounting mechanism can be configured to connect to a standard T-bar grid structure. The mounting mechanism can be part of the body component itself or can be connected to the body by a mounting mechanism connection feature. The body component itself can connect to the mounting surface or can connect to the mounting surface through the intermediate mounting mechanism. Several examples of mounting mechanisms are discussed in further detail below including clip-based structures, hook and loop based structures and complimentary surface based structures.

Throughout this description, the preferred embodiment and examples illustrated should be considered as exemplars, rather than as limitations on the present invention. As used herein, the term "invention," "device," "method," "present invention," "present device" or "present method" refers to any one of the embodiments of the invention described herein, and any equivalents. Furthermore, reference to various feature(s) of the "invention," "device," "method," "present invention," "present device" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "outer", "above", "lower", "below", "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," "includes" and/or "including when used herein, specify the presence of stated features, integers, steps, operations, elements, and/or components, but do not preclude the presence or addition of one or more other features, integers, steps, operations, elements, components, and/or groups thereof.

As used herein, the term "lighting element" refers to any structure that can emit light in response to an electrical signal and includes LEDs and LED devices containing one or more LEDs arranged into an array or incorporated into a light engine.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

Before discussing the individual elements of various embodiments according to the present disclosure, it is helpful to first view an example of a lighting system according to the present disclosure connected to an existing T-bar grid. FIG. 1 shows a lighting system 100, comprising a body component 102, connected to an existing ceiling T-grid 104. Lighting system 100 is shown here with two end portions 106. End portions 106 correspond to where one body component 102 ends and can comprise a number of different structures such as endcaps or connection joints. Connection joints can include singular connection joints, which are arranged such that additional body components can connect to body component 102. This type of connection joint is referred to as a singular connection joint or a "singular connector" as it allows connection to only one other body component (two components total). These singular connection joints can allow for a straight connection of multiple body components. T-connection joints, quad connection joints and moveable connection joints are further types of connection joints that will be discussed further below. As shown in FIG. 1, lighting system 100 fits over the existing T-bar grid structure. In other embodiments, body 102 can fit over an existing track lighting arrangement. It is understood that body 102 can also attach to many different surfaces including but not limited to ceiling, walls, floors, furniture, household appliances, other lighting systems and/or existing support or grid structures.

It is understood that connection joints according to this present disclosure can be separate structures connected to a body component or can be integrated into the body component or be part of the body component itself. These connection joints can comprise different amounts of openings, some of which are described herein and can facilitate and enable the formation of various types of desired arrays.

While body component 102 in FIG. 1 is shown to be a cylindrical shape, it is understood that body components according to the present disclosure can comprise many different shapes. For example, such body components can be the shape of any regular polygon (e.g. square, rectangular, circular, triangular) or can comprise any number of irregular shapes that would achieve a desired output beam profile of emitted light. It is also understood that a portion of the body, or its entirety, can comprise a lens, and that lenses according to the present disclosure can comprise any number of shapes as well.

FIG. 2 shows a lighting system 150, comprising a body component 152, a lens component 154, a lighting element 156 (the lighting element comprising at least one LED 158 and a PCB 160), a lighting element securing mechanism 162 (which secures PCB 160 into a desired position), a free space portion 164, and surface mounting mechanism 166, which connects lighting system 150 to T-bar 168. As shown in FIG. 2, lighting system 150 directly connects to the T-bar 168 of an existing T-bar ceiling grid and does not substantially extend past ceiling tiles 170 into the ceiling plenum space.

The embodiment shown in FIG. 2 depicts lens component 154 as being a separate structure from body component 152, although it is understood, as discussed above, that the lens component 154 can be integrated with body 152, for example, utilizing an extrusion process, or the body itself can be the lens component. Lens component 154 can be connected to body component 152 at a connection point 172. Various connection features can be utilized including but not limited to a living hinge, an adhesive compound, soldering, various means of permanent attachment and a snap-fit structure (wherein a structure on lens component 154 can interact or mate with a corresponding structure on body component 152).

The embodiment shown in FIG. 2 depicts surface mounting mechanism 166 as an integrated portion of body 152 that can grip or clip to T-bar 168, however it is understood that mounting mechanism 166 can comprise several different mounting mechanisms as discussed above, including but not limited to clip-based structures, hook and loop based structures and complimentary surface based structures. In some embodiments, mounting mechanism 166 can be a separate structure to body 152 and be directly mounted to a surface, such as T-bar 168. Body 152 can then comprise a structure to connect to the mounting mechanism 166 and thus be connected to T-bar 168 through the intermediate mounting mechanism. In some embodiments, lighting system 150 is comprised of a light weight material so that the body can be held in place by the weight of the ceiling tile, essentially by having a portion of mounting mechanism 166 sandwiched between the T-bar 168 and a ceiling tile 170, as is shown in FIG. 2 at point 174

Various features can be integrated into lighting system 150, for example, by utilizing free space 164. Free space 164 can house various connection materials such as wires and leads as well as various electrical or electronic components. For example, current and voltage converters can be included in order to condition an electrical signal from a remote power supply to the input voltage and current to drive the appropriate design voltage and current of the LED circuit. Free space 164 can comprise various internal structures such as tabs, hooks and other securing mechanisms to organize and secure stored connection materials and components.

Lighting element securing mechanism 162 can comprise various structures to secure the lighting element into place. In the embodiment shown, PCB 156 is held in between a top portion 176 and a base portion 178 of lighting element securing mechanism 162. Lighting element securing mechanism 162 can be formed integrally with the body component 152 during formation of the body component 152. The top portion 176 of lighting element securing mechanism 162 can also be made reflective, for example, reflective white, in order to improve light extraction of lighting system 150.

Many different embodiments can be utilized incorporating features of the present invention. FIG. 3 shows a lighting system 200, similar to lighting system 150 in FIG. 2 above, wherein the corresponding disclosure is incorporated into the present embodiment. Lighting system 200 comprises a body component 202, a lens component 204, a lighting element 206 (the lighting element comprising at least one LED 208 and a PCB 210), a lighting element securing mechanism 212 (which secures PCB 210 into a desired position), and surface mounting mechanism 214, which connects lighting system 200 to T-bar 216. Lens 204 is shown connected to body 202 via a snap-fit connection 218, although other connections as mentioned above can be utilized, lens component 204 can be formed integral to body component 202, or body component 202 can itself be the lens component. Lens 204 is shown with an irregular shape comprising winged portions 220. Winged portions 220 can be arranged to further direct emitted light in a desired output profile and can also comprise opaque portions or otherwise be arranged to conceal the presence of surface mounting mechanism 214 for aesthetic purposes. Although a linear form factor is represented in the current embodiment, additional shapes, such as, round, square, oval, and rectangular are also envisioned for specific applications.

Surface mounting mechanism 214 is an intermediate mounting mechanism in that body component 202 connects to surface mounting mechanism 214 which in turn connects to T-bar 216, rather than body component 202 connecting to T-bar 216 directly itself. There are many advantages to utilizing an intermediate mounting mechanism. In some embodiments, the intermediate mounting mechanism can be arranged to facilitate manual operation of the position of a body component in relation to a mounting surface. In other embodiments, the intermediate mounting mechanism can be arranged such that a body component can be freely connected and removed from a mounting surface, for example to redesign a lighting arrangement or to replace or repair an existing lighting arrangement.

Many different intermediate mounting mechanisms can be utilized as discussed above and as will be discussed further below. In the embodiment shown, the surface mounting mechanism comprises at least two portions, a body component connecting portion 222 (which connects to body 202) connected to a surface connecting portion 224 (which connects to T-bar 216). As shown in FIG. 3, body 202 can comprise surface mounting mechanism gripping portions 226 which can connect to body component connection portion 222, for example, by comprising a corresponding structure that can interact or mate with a structure on body component connection portion 222. In the embodiment shown, body component connecting portion 222 comprises a cam lock and surface connection portion comprises a clip mechanism. The cam lock and clip mechanism can interact as a knock-down or conformat fastener. These types of fasteners typically comprise a cam dowel which can be locked by a cam lock installed in adjacent members. Body component connecting portion 222 and surface connecting portion 224 can be brought closer together, and the joint tightened, by turning the cam lock portion 222.

Figure 4:
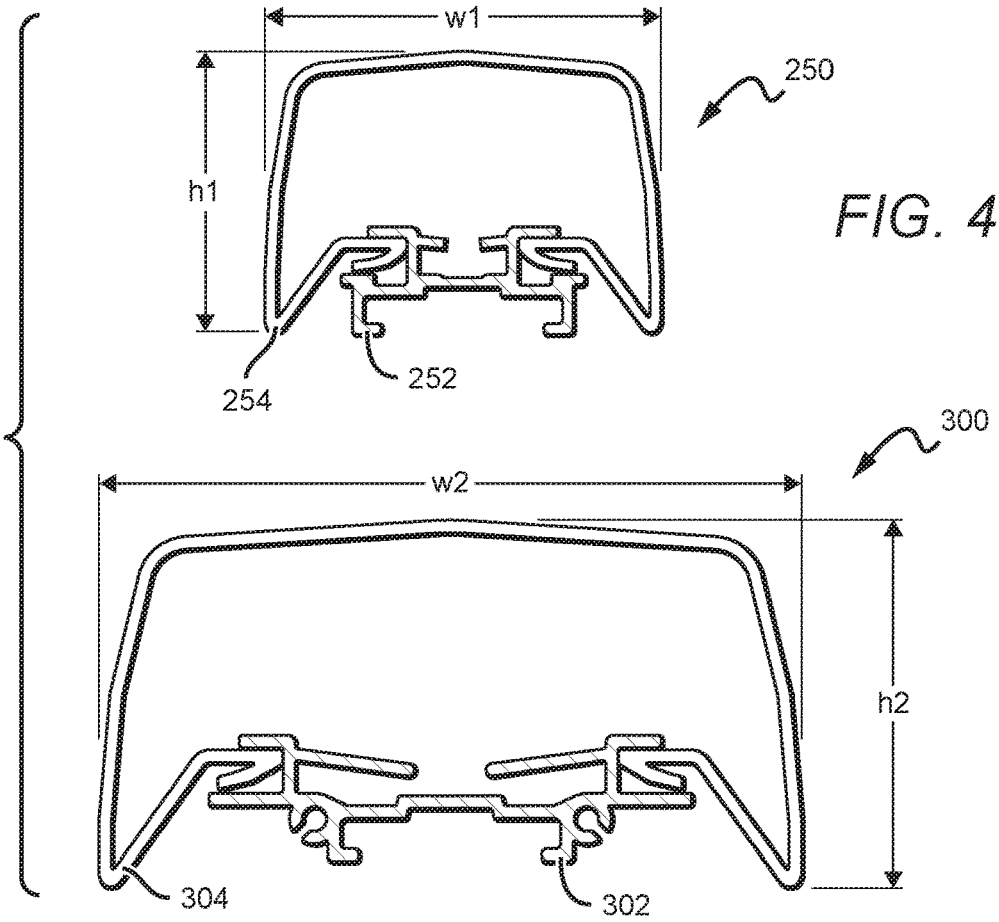
FIG. 4 is a comparison view of two embodiments of lighting systems according to the present disclosure.

Lighting systems according to the present disclosure can comprise a variety of lens and body dimensions. FIG. 4 shows a comparison between embodiments of a lighting system 250 and another larger lighting system 300, similar to the embodiment shown in FIG. 3, wherein the corresponding disclosure is incorporated into the present embodiment. Lighting system 250 comprises a body component 252 and a lens component 254 and lighting system 300 comprises a body component 302 and a lens component 304.

Lighting system 250 and lighting system 300 are similar however, they comprise different dimensions and slight alterations in body component shape to accommodate for these different dimensions. Lighting system 250 has a height (h1) of 1.02 inches and it has a width (w1) of 1.5 inches. Lighting system 300 has a height (h2) of 1.18 inches and it has a width (w2) of 2.35 inches. In evaluating the desired sizes of the lighting systems, the smaller size (lighting system 250) has an advantage of being able to blend in with a typical ceiling T-grid more closely in relation to the size of the grid. Although there are arrangements in which the larger size embodiment would be preferred.

Various surface mounting mechanisms can also be utilized with embodiments incorporating features of the present invention. FIG. 5 shows an intermediate cam lock style mounting mechanism 350, similar to surface mounting mechanism 214 in FIG. 3 above. Surface mounting mechanism 350 comprises two portions, a body component connecting portion 352 (which connects to body component of a lighting system) and a surface connecting portion 354 (which connects a desired mounting surface). Body component connection portion 352 has a structure such that it can facilitate connection to a lighting system body component, for example, in the embodiment shown, body component connection portion 352 comprises ridged structures 356 which can interact or mate with a corresponding structure on a body component of a lighting system. Utilizing this structure, a body component can connect to body component connection portion 352 which in turn can connect to surface connecting portion 354 already connected to a mounting surface. The body component can be secured into place by rotating either the body component itself or the body component connection portion 352, for example by manually operating the handle portion 357, such that the connection between the body component connection portion 352 and the surface connecting portion 354 is tightened.

Surface connecting portion 354 has a structure such that it can facilitate connection to a to a desired mounting surface, for example, in the embodiment shown, surface component connection portion 354 comprises clip structures 358 which can interact or mate with a corresponding structure on a surface, such as a T-bar in a surface grid. Body component connecting portion 352 and a surface connecting portion 354 are connected together at point 360 via a cam lock mechanism as is describe above and the connection can be tightened by rotating body component connection portion 352.

Many other surface mounting mechanisms can be utilized with embodiments incorporating features of the present invention. For example, a hook and loop connection (such as Velcro®) can be utilized (especially in embodiments where a body component comprises a light weight material). One-half of the hook and loop bond can be connected to, either temporarily or permanently, a body component and the other half connected to, either temporarily or permanently, a mounting surface such as a wall or a ceiling, such that the body component can be connected to the mounting surface. Other complimentary structures can be utilized as surface mounting mechanisms such that one-half of a mounting mechanism is connected to a body component and the another half is connected to a mounting surface, such that the two halves can be connected together in order to connect the body to the mounting surface. Complimentary magnetic structures can also be utilized in this manner. In some embodiments, multiple intermediate structures can be used such that a body component can be connected to a surface mounting mechanism which in turn is connected to one or more additional surface mounting mechanisms, which is ultimately connected to a mounting surface. Other surface mounting mechanisms can be utilized including but not limited to temporarily or permanent adhesives, glues, cements, single- or double sided adhesive strips or structures (which can also be designed to interact with or mate with portions of a body component), hooks, screws and fasteners.

In some embodiments, the mounting mechanism can be configured such that a body component can be mounted to a surface that is not an existing surface grid system (such as a T-bar grid or a track lighting arrangement), for example a flat ceiling or wall. In these embodiments, such lighting systems can comprise manually operable mounting mechanisms allowing for body components to be freely removed and/or replaced from a mounting surface as needed. Any of the above surface mounting mechanisms can be adapted for this purpose. For example, FIG. 6 shows a mounting mechanism 400, comprising a body component connecting portion 402 (which connects to body component of a lighting system) and a surface connecting portion 404 (which connects a desired mounting surface). Body component connecting portion 402 is similar to body component connecting portion 354 above, however, surface connecting portion 404 is configured to serve as an anchor in a surface, such as a ceiling or wall (e.g. drywall, plaster, etc.). Surface connecting portion 404 can penetrate the mounting surface and serve as an anchor allowing body component connecting portion 402 (and a connected body component) to connect to surface connecting portion 404. The two structures 402, 404 can then be further tightened together and secured via retaining washer 406 and machine screw 408.

Figure 7:
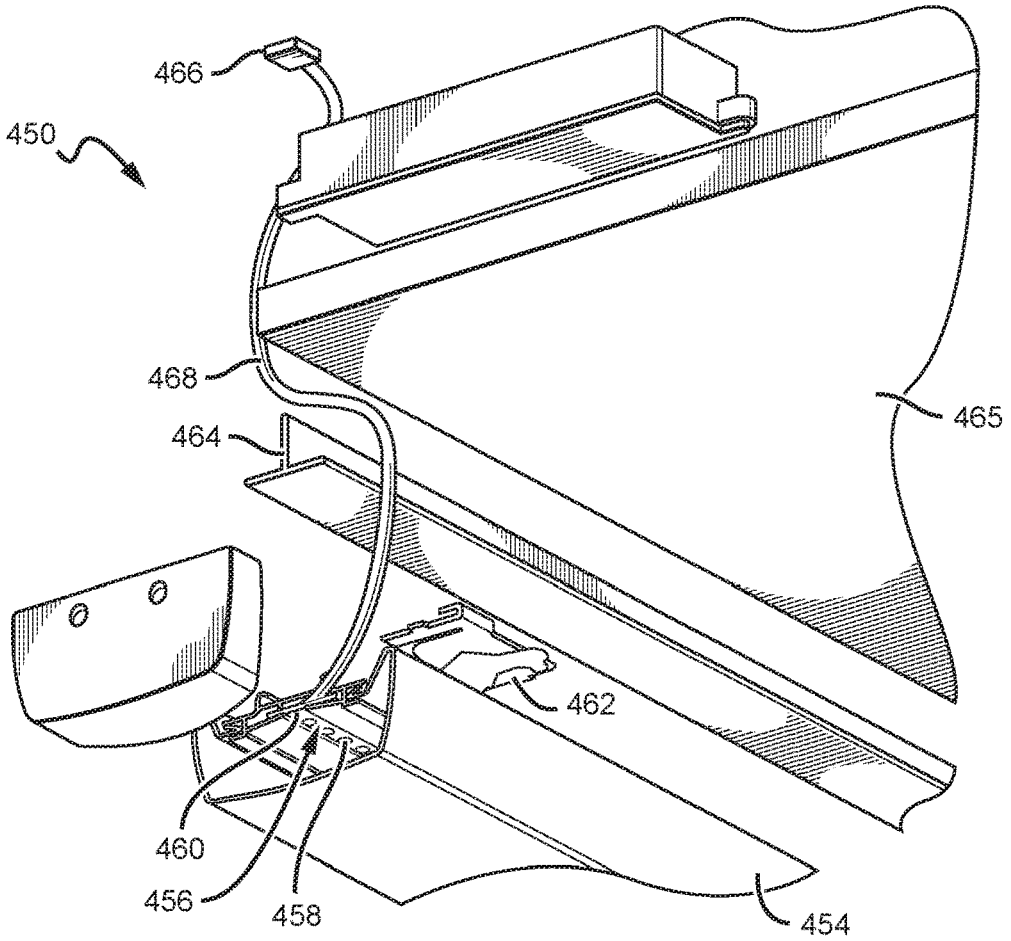
FIG. 7 is an exploded view of an embodiment of a lighting system according to the present disclosure.

Lighting systems according to the present disclosure can utilize a remote power supply. FIG. 7 shows a lighting system 450, similar to lighting system 200 in FIG. 3 above, wherein the corresponding disclosure is incorporated into this embodiment. Lighting system 450 comprises a body component 452, a lens component 454, a lighting element 456 (the lighting element comprising at least one LED 458 and a PCB 460), and a surface mounting mechanism 462, which connects lighting system 450 to T-bar 464. For positional perspective, ceiling tile 465 is also shown.

Lighting system 450 is provided power by a remote power supply 466, which can be connected to the lighting element 456 by electrical connection pathway 468, which can be any electrically conductive wire, cable, trace or conduit, for example, a CAT-5 cable. The remote power supply 466 can be positioned in the ceiling, connected to an existing surface grid (as shown), or can be positioned elsewhere, for example in an inconspicuous corner of the room. The remote power supply 466 can be disguised to look like or blend in with common objects for aesthetic purposes. As mentioned above, other electronic components can be housed inside body 452, for example voltage and current converters in order to further condition the electrical signal from remote power supply 466.

Figure 8:
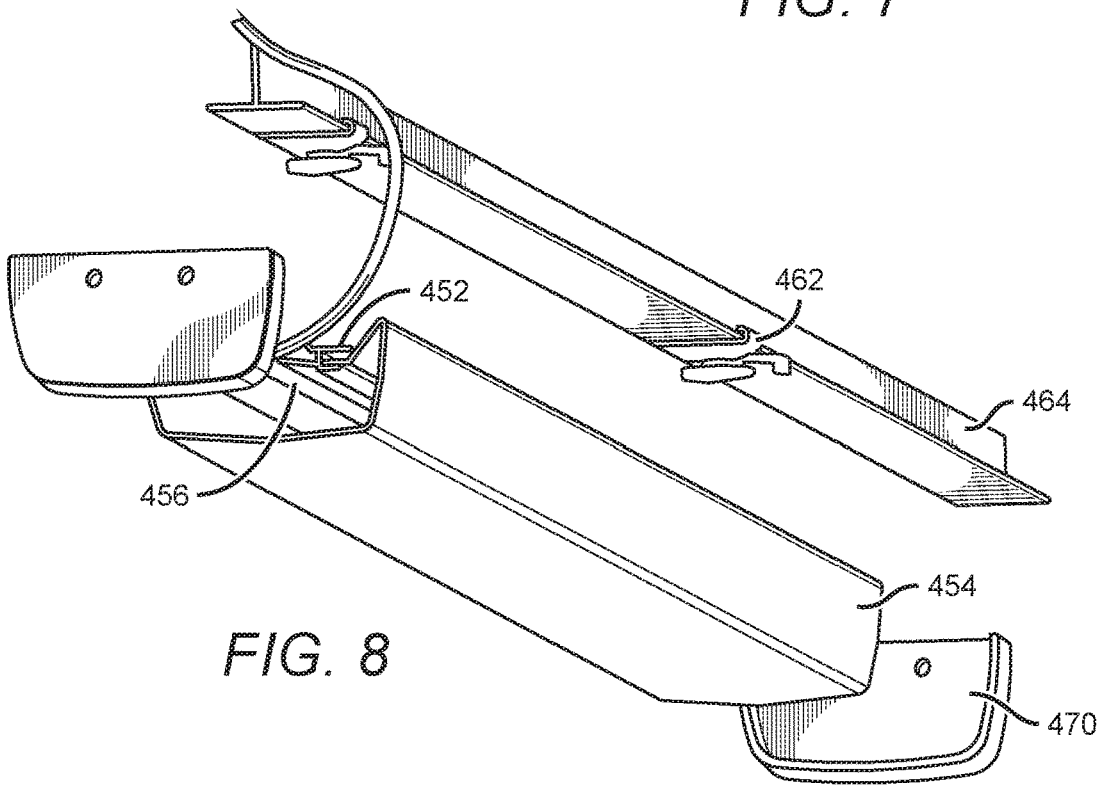
FIG. 8 is another exploded view of the embodiment of a lighting system shown in FIG. 7.

FIG. 8 is another view of lighting system 450 comprising body component 452, lens component 454, lighting element 456, and surface mounting mechanism 462, which connects lighting system 450 to T-bar 464. This view, depicted in FIG. 8, shows surface mounting mechanisms 462 attached to T-bar 464. This view also better shows the endcaps 470, which can be used to close off ends of the lighting system if no connections to additional body components are desired. Endcaps 470 can provide additional protection of internal components.

The modular aspects of lighting systems according to the present disclosure will now be discussed in further detail. FIG. 9 shows the outer portion of a lighting system 500, connected to a T-bar grid 501, which comprises a body component 502 and two additional body components 504, 506 connected together by a connection joint 508. As depicted in FIG. 9, connection joint 508 is a T-connection joint or "T-connecter," which can connect up to three separate body components. FIG. 9 depicts connection joint 508 connecting body component 502 with the other body components 504, 506. FIG. 9 further depicts a surface mount supporting structure 510, which can connect to a surface, such as T-grid 501, as shown, and provide support and mounting stability for longer body components, such as body component 502. In embodiments wherein multiple body components are linearly connected together rather than using a single longer body component, a singular connection joint, joining two linear sections and connected to the mounting surface, can be used in lieu of or in addition to surface mount supporting structure 510.

Connection joints are further detailed in FIG. 10, which shows a T-connection joint 550, similar to connection joint 508 in FIG. 9 above, wherein the corresponding disclosure is incorporated into this embodiment. Connection joint 550 can be made from the same materials listed above for the body components or any other suitable rigid or otherwise sturdy material that is known in the art. Connection joints according to the present disclosure can be arranged such that body components can connect to the connection joint, for example, by having openings 552 that correspond in shape or size to a part of a body component or by comprising various body component-accepting structures that facilitate connection to body components. For example grooved structures 554, which can correspond to other structures on a body component.

Connection joint 550 can further comprise electrical or electronic components which are housed in an electronic component housing 556 which can also utilize grooved structures 554 to secure the electronic component housing in connection joint 550. Electronic component housing 556 can house various electrical or electronic components, such as voltage and current converters, to condition an electrical signal from a remote power supply to the input voltage and current to drive the appropriate design voltage and current of the LED circuit. The electronic component housing can provide electrical connection to lighting elements within connected body components at all openings 552, for example through utilizing electrical connection holes 558, which allow access to the internal electronic components that are housed within electronic component housing 556. The electronic component housing 556 can comprise an opaque material to hide the appearance of the electronic components therein for aesthetic purposes.

The top surface 560 of connection joint 550, or another surface, or its entirety, can comprise the same physical properties of an attached body component or can comprise different ones. In some embodiments, the top surface 560 comprises a diffuse material. In other embodiments top surface 560 can be translucent, diffuse, opaque or reflective or a combination thereof.

Various structures and arrangements can also be utilized with a body component to facilitate connection of multiple body components to a connection joint. FIG. 11 shows a partial view of body components 600 that can be utilized with embodiments incorporating features of the present invention. As shown in FIG. 11, multiple body components can comprise mitered ends 602 which allow for tighter fitting into connection joint intersections. These mitered ends also allow for more continuous appearance of illuminated shapes without dark ends/corners.

Figure 12:
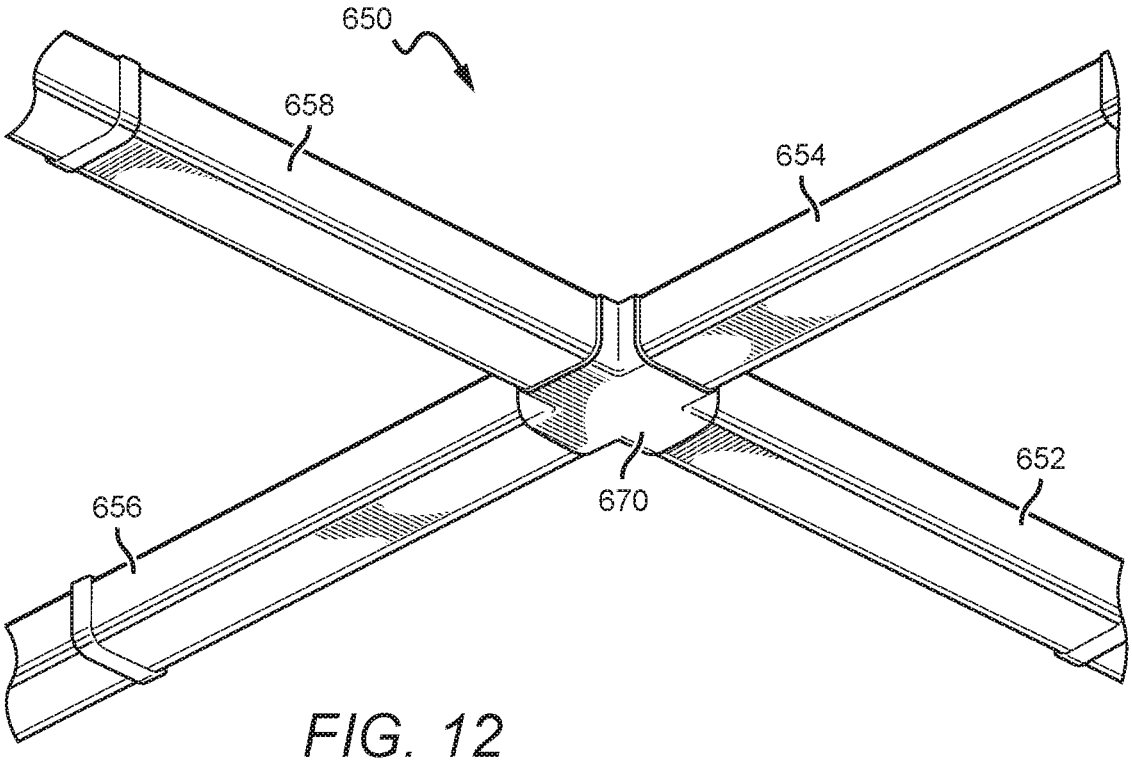
FIG. 12 is a bottom perspective view of an embodiment of a lighting system according to the present disclosure.

Another type of connection joints that can be utilized with embodiments incorporating features of the present invention are quad-connection joints or "quad-connectors." FIG. 12 shows a lighting system 650 comprising four body components 652, 654, 656, 658 connected together at a quad connection joint 670. Quad-connection joint 670 is similar to T-connection joint 550 in FIG. 10 above and can comprise the same features, however, unlike T-connection joint 550, quad-connection joint 670, has four opening portions rather than three, allowing four body components to be connected together as is depicted in FIG. 12.

Figure 13:
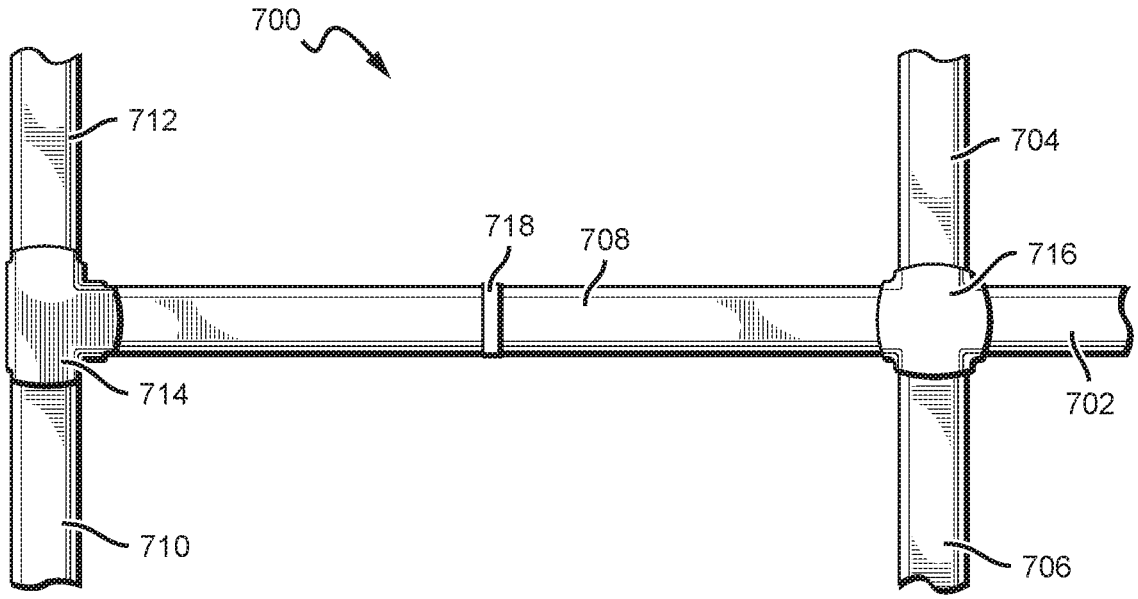
FIG. 13 is a bottom perspective view of an embodiment of a lighting system according to the present disclosure.

Various other connection joints can be utilized according to the present disclosure with variable numbers of openings (e.g. five or six openings). The various connection joints can be mixed and matched with body components to provide increased flexibility in designing lighting arrangements for a space. For example, FIG. 13 shows a lighting system 700 comprising six separate body components 702, 704, 706, 708, 710, 712, which are connected together by a T-connection joint 714 and a quad connection joint 716. Additional support can be provided to the longer body components (i.e. body component 708) by surface mount supporting structure 718, which is similar to surface mount supporting structure 510 in FIG. 9 above.

The multitude of combinations of body components and connection joints results in greatly increased freedom of lighting arrangement design. It is also important to note that the lighting systems need not be permanently fixed into a completed arrangement once one has been designed, although they certainly can be. Various body components of a completed lighting system can be freely removed from connection joints, rearranged in relation to one another, and reconfigured in other arrangements as desired for producing a specific lighting arrangement. This allows lighting systems according to the present disclosure to be freely altered and rearranged as need, providing increased flexibility in design and allowing for a lighting system to be moved and used to efficiently light different spaces without damaging the lighting system.

Figure 14:
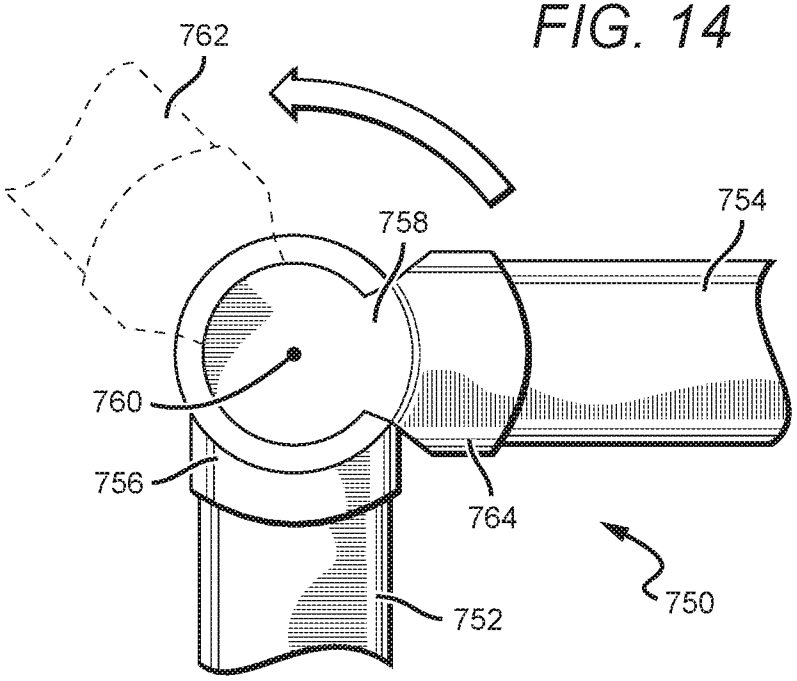
FIG. 14 is a top operational view of a connection joint that can be utilized with lighting systems according to the present disclosure.

Connection joints incorporating features of the present invention can also comprise movable features, allowing for even more customization of lighting system output. FIG. 14 shows a movable connection joint 750, that comprises two openings that allows it to connect to a first body component 752 and a second body component 754. The connection joint 750 comprises a stationary portion 756 connected to a movable portion 758. Various rotation mechanisms can be utilized that allow the body component connection portions of connection joint 750 to move in relation to the other one. In the embodiment shown, the moveable portion 758 is arranged to pivot along an axis point 760 such that body component 754 can move to one or more alternative positions 762.

The rotation of the joint can be restricted, for example to a field of 180 degrees through various means including fin structures 764 that can abut against portions of a body component or joint 750 and restrict further movement. Moveable connection joint 750 can be designed such that there are several preset positions in which body component 754 can occupy or can allow for free range of motion or restriction of motion to a preset range. Moveable connection joint 750 can also further comprise a locking mechanism that can fix the position of body component 754 in a desired place in embodiments allowing a full range of motion.

Various movement arrangements are possible that incorporate features of the present invention. For example, a moveable connection joint need not be restricted to rotational movement, but can comprise a number of moveable joint arrangements including but not limited to: a ball and socket joint arrangement, a hinge or living hinge arrangement and a vertical rotational movement arrangement. Also, the connection joint can simply be made of a flexible material that allows for connected body components to stretch, twitch or otherwise orientate themselves in various spatial ways in relation to one another. Also, different moveable joint structures are possible including moveable joints with more than two openings wherein each opening can be arranged to be moveable in relation to one or more of the other openings, for example a moveable t-connector joint or a moveable quad-connector joint.

Figure 15:
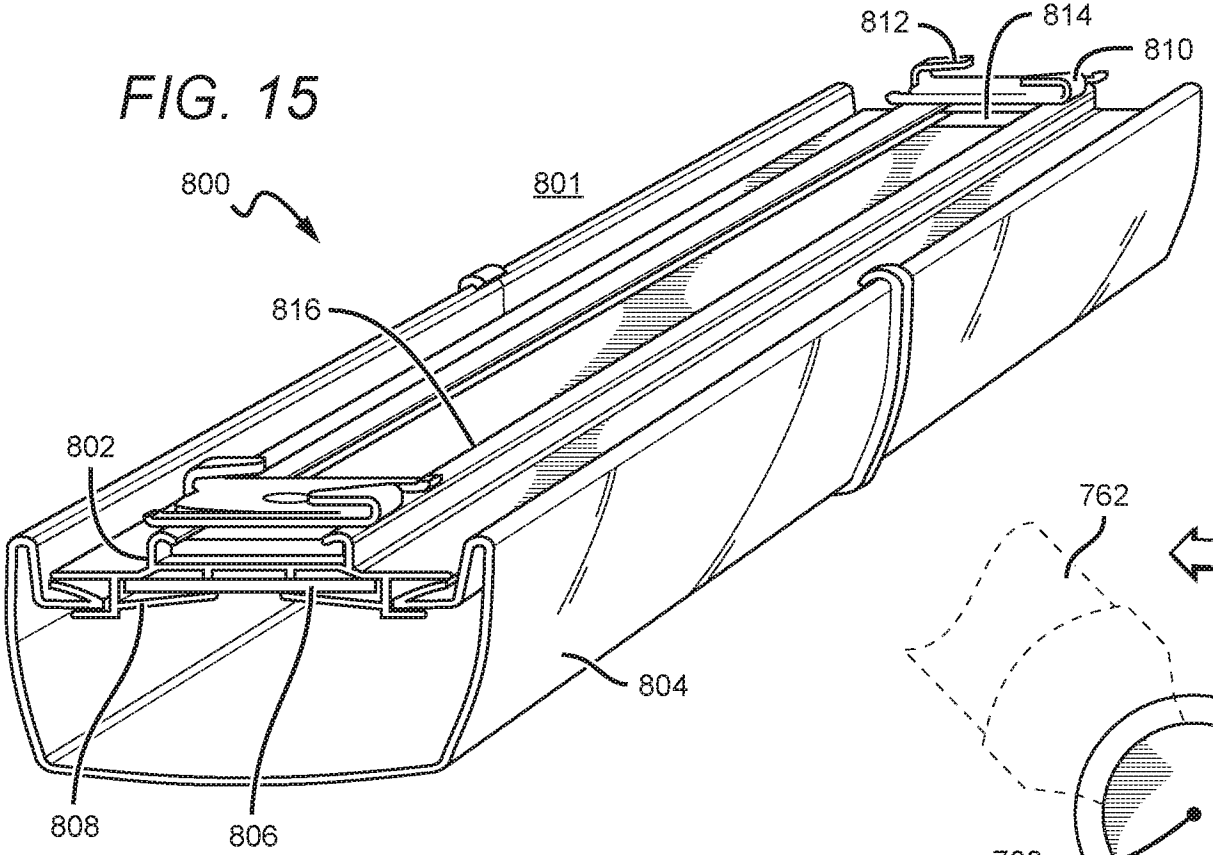
FIG. 15 is a front perspective view of an embodiment of a lighting system according to the present disclosure.

Various other embodiments that were briefly mentioned above are now examined in greater detail. FIGS. 15 and 16 show an embodiment of a lighting system 800 in a perspective view 802 and an exploded view 803. Lighting system 800 is similar to lighting system 200 in FIG. 3 above, wherein the corresponding disclosure is incorporated into the present embodiment. Lighting system 800 comprises a body component 802, a lens component 804, a lighting element 806 (which can comprise multiple lighting element PCB platforms as shown), a lighting element securing mechanism 808, and surface mounting mechanism 810, which connects lighting system 800 to a mounting surface. Lighting system 800 differs from lighting system 200 in that the surface mounting mechanism 810 is a single element, rather than the two-part cam lock and clip element of lighting system 200. The clip portion 812 of surface mounting mechanism 810 can attach to a surface such as a T-bar and the base portion 814 can slide into receiving grooves 816 on body component 802. Surface mounting mechanism 810 can be arranged with a rotational element 818, which can allow the clips to be rotated into place. Lighting system 800 can further comprise a support joint 820 to provide further structural stability to the lighting system 800.

FIGS. 17 and 18 show an embodiment of a lighting system 900 in a perspective view 902 and an exploded view 903. Lighting system 900, similar to lighting system 200 in FIG. 3 above, wherein the corresponding disclosure is incorporated into the present embodiment. Lighting system 900 comprises a body component 902, a lens component 904, a lighting element 906 (which can comprise multiple lighting element PCB platforms as shown), a lighting element securing mechanism 908, and surface mounting mechanism 910, which connects lighting system 900 to a mounting surface.

Lighting system 900 differs from lighting system 200 in that the surface mounting mechanism 910 is a two piece complimentary structure, rather than the two-part cam lock and clip element of lighting system 200. The two-piece complimentary structure 910 can comprise any complimentary structure that encourages connection of the two pieces. One piece is connected to the lighting system 900 and the other piece is connected to a mounting surface. Examples of complimentary two-piece structures include adhesives, snap-fit structures and hook and loop structures. Lighting system 900 can further comprise a support joint 912 to provide further structural stability to the lighting system 900.

FIG. 19 depicts a lighting system 1000, similar to lighting system 200 in FIG. 3 above, wherein the corresponding disclosure is incorporated into the present embodiment. Lighting system 1000 comprises a body component 1002, a lens component 1004, a lighting element 1006 (the lighting element comprising at least one LED 1008 and a PCB 1010), a lighting element securing mechanism 1012 (which secures PCB 1010 into a desired position), and surface mounting mechanism 1014, which connects lighting system 1000 to a mounting surface.

In lighting system 1000, body component 1002 and lens 1004 are extruded as one element of the same material or co-extruded such that body component 1002 and lens component 1004 are integral to one another but comprise different materials. For example body component 1002 can be co-extruded with lens component 1004 such that lens component 1004 comprises a translucent material and body component 1004 comprises a reflective material (for example to make the top portion of lighting element securing mechanism 1012 reflective). Body component 1002 can also be extruded as a single piece of material such that the body component itself comprises the lens component 1004.

In some embodiments, lens component 1004 is co-extruded with body component 1002 such that lens 1004 is connected to body 1002 by a living hinge. Such living hinge arrangements are described in detail in U.S. patent application Ser. No. 13/782,820 (issued as U.S. Pat. No. 9,482,396) to Mark Dixon, et al., entitled Integrated Linear Light Engine, which is hereby incorporated in its entirety by reference into the present application, including the drawings, charts, schematics, diagrams and related written description.

FIG. 20 depicts a lighting system 1050, similar to lighting system 200 in FIG. 3 above, wherein the corresponding disclosure is incorporated into the present embodiment. Lighting system 1050 comprises a body component 1052, a lens component 1054, a lighting element 1056 (the lighting element comprising at least one LED 1058 and a PCB 1060), a lighting element securing mechanism 1062 (which secures PCB 1060 into a desired position), and surface mounting mechanism 1064, which connects lighting system 1050 to a mounting surface.

In lighting system 1050, body component 1052 and lens component 1054 are manufactured separately and then later connected. The connection can be permanent or temporary. As shown, body component 1052 is connected to lens component 1054 via a snap-fit structure arrangement. Such snap fit structure arrangements as well as other connection arrangements are described in detail in U.S. patent application Ser. No. 13/782,820 (issued as U.S. Pat. No. 9,482,396) to Mark Dixon, et al., entitled Integrated Linear Light Engine, which is hereby incorporated in its entirety by reference into the present application, including the drawings, charts, schematics, diagrams and related written description.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A ceiling lighting system comprising:

a body component comprising a surface mounting mechanism and a light element securing mechanism, the light element securing mechanism supporting at least one light emitting diode (LED) based lighting element and the surface mounting mechanism configured to mount to a grid structure for a suspended ceiling such that the body component, the light element securing mechanism and the at least one LED based lighting element extend below the grid structure, wherein the body component and the light element securing mechanism combine to define a free space portion, the free space portion containing electrical components such that the free space portion and the electrical components are disposed below the grid structure; and a lens over the at least one LED based lighting element and comprising at least two winged portions having opaque portions, wherein the lens is configured such that a portion of the lens extends above the light element securing mechanism and substantially to the grid structure when the surface mounting mechanism is mounted to the grid structure.

2. The modular lighting system of claim 1, further comprising a power conversion system located remote from the body component and configured to deliver current to the at least one LED based lighting element.

3. The modular lighting system of claim 1, further comprising a power conversion system proximately coupled to at least one of the body component and a connection joint, and configured to deliver current to the at least one LED based lighting element.

4. The lighting system of claim 1, wherein the at least two winged portions extend upward and away from the surface mounting mechanism.

5. The lighting system of claim 1, wherein the at least two winged portions extend upward and outward.

6. The lighting system of claim 1, wherein the at least two winged portions extend upward and outward so as to at least partially conceal the surface mounting mechanism when the lighting system is viewed from below.

7. The lighting system of claim 1, wherein the lens is connected to the body component by at least two connection points, and wherein the at least two winged portions extend outward and upward above the at least two connection points.

8. A ceiling lighting system comprising:

a body component comprising a surface mounting mechanism and a light element securing mechanism, the surface mounting mechanism configured to attach to a T-bar which forms a portion of a suspended ceiling structure;

a light emitting diode (LED) based lighting element supported by the light element securing mechanism; and a lens over the LED based lighting element and comprising at least two winged portions having opaque portions;

wherein the surface mounting mechanism comprises a body component connecting portion connected to the body component and a surface connecting portion configured to attach to the T-bar, wherein a cam lock portion joins the body component connecting portion and the surface connecting portion such that actuation of the cam lock portion moves the body component connecting portion closer to the surface connecting portion.

9. The ceiling lighting system of claim 8, wherein at least a portion of the surface connecting portion overlaps at least a portion of the T-bar.

10. The ceiling lighting system of claim 8, wherein a portion of the surface connecting portion rests on a surface of a grid structure for the suspended ceiling structure.

11. The ceiling lighting system of claim 8, wherein the body component connecting portion comprises ridged structures configured to mate with a corresponding structure on the body component.

12. The ceiling lighting system of claim 8, wherein the body component connecting portion and the body component are rotated relative to one another to secure the body component to the body component connecting portion.

13. The ceiling lighting system of claim 8, wherein the surface connecting portion comprises clip portions for mating with the T-bar.

14. The ceiling lighting system of claim 8, wherein the body component connecting portion is releasably connected to the body component.

15. The ceiling lighting system of claim 8, wherein the surface connecting portion releasably attaches to the T-bar.

16. The ceiling lighting system of claim 8, wherein the body component connecting portion is releasably connected to the body component and the surface connecting portion releasably attaches to the T-bar.

17. A ceiling lighting system comprising:

a body component comprising a light element securing mechanism, and a surface mounting mechanism configured to attach to a T-bar which forms a portion of a suspended ceiling structure;

a light emitting diode (LED) based lighting element supported by the light element securing mechanism; and a lens over the LED based lighting element and comprising at least two winged portions having opaque portions;

wherein the surface mounting mechanism comprises a body component connecting portion connected to the body component and a surface connecting portion configured to attach to the T-bar, wherein a cam lock portion joins the body component connecting portion and the surface connecting portion such that rotation of the cam lock tightens the body component connecting portion to the surface connecting portion.

18. The ceiling lighting system of claim 17, wherein the body component connecting portion and the body component are rotated relative to one another to secure the body component to the body component connecting portion.

* * * * *